United States Patent [19]

Colman

[11] Patent Number: 4,714,231

[45] Date of Patent: Dec. 22, 1987

[54] ADJUSTABLE MOLD FOR THE MANUFACTURE OF CONCRETE ELEMENTS SUCH AS STAIRCASES

[76] Inventor: Bernard Colman, 7 Rue Jean Bouyssou, 31500 Toulouse, France

[21] Appl. No.: 850,909

[22] Filed: Apr. 8, 1986

[51] Int. Cl.[4] ..... B28B 7/22

[52] U.S. Cl. ..... 249/14; 249/112; 249/157; 249/159; 249/160; 249/170

[58] Field of Search ..... 249/14, 112, 155, 157, 249/158, 159, 160, 170, 171

[56] References Cited

FOREIGN PATENT DOCUMENTS

| | | |
|---|---|---|
| 666648 | 11/1965 | Belgium . |
| 869765 | 3/1953 | Fed. Rep. of Germany . |
| 1934586 | 4/1971 | Fed. Rep. of Germany . |
| 2243250 | 3/1974 | Fed. Rep. of Germany . |
| 1211716 | 3/1960 | France . |
| 581676 | 10/1946 | United Kingdom . |

*Primary Examiner*—Jay H. Woo
*Assistant Examiner*—Karl D. Sturge
*Attorney, Agent, or Firm*—Young & Thompson

[57] ABSTRACT

The present invention has as an object an adjustable mold for the manufacture of concrete elements such as staircases of the type having a straight line extent, of which the treads are perpendicular or not perpendicular to the risers. The adjustable mold according to the invention comprises a frame (1) on which is mounted a base (2), a front lateral wall, a back lateral wall (4) and two longitudinal walls (5), the said base being constituted by juxtaposed molding elements (6) each provided in a dihedral angle which dihedral angle is constituted by a wall intended to form the tread and by a wall intended to form the riser and is characterized in that each molding element (6) is supported by carriages mounted movably on horizontal guide rails (10) longitudinally to the mold, mounted on the frame (1) and in that a flexible strip (11) sealed to the concrete is stretched by stretchers (12) mounted at each extremity of the mold and is forced to cover and conform to the shape of the base (2) of the mold by winding on rollers (13), mounted beneath the base (2) each between two elements (6), and by gripping between the molding elements when these latter are maintained pressed the ones against the others by jacks.

17 Claims, 9 Drawing Figures

ADJUSTABLE MOLD FOR THE MANUFACTURE OF CONCRETE ELEMENTS SUCH AS STAIRCASES

FIELD OF THE INVENTION

The present invention has an object a mold for the manufacture of concrete elements such as staircases of the type with a straight-line extent, of which the treads are perpendicular or not perpendicular to the risers.

BACKGROUND OF THE INVENTION

It is known that the installation of a staircase in a building introduces a certain number of constraints. So as to determine the dimensional characteristics of a staircase, one skilled in the art must take account of the available space and observe the customary dimensional relation between the height of the riser and the width of the tread. For this reason it is difficult to standardize the dimensions of a staircase and this latter may not be prefabricated in series.

So as to construct staircase, it is desirable to take account of the actual dimensions of the staircase housing, and not those initially provided by the architect. In effect, taking account of the dimensional tolerances allowed in the profession, the actual dimensions of the staircase housing may differ some centimeters from those initially provided. These dimensional deviations are conventionally compensated for on the dimensions of the steps of the staircase.

So as to reduce the cost of manufacture of staircases, these latter are realized in molded concrete. In the field of this technique, adjustable molds are conventionally used which permit realizing staircases of different dimensions, that is to say staircases having differing dimensions of extent, riser height and tread width.

Such molds generally comprise a series of elements for molding steps each constituted by a first metallic wall intended to form the tread and by a second metallic wall intended to form the riser.

These two walls are rigidly fixed the one to the other and are perpendicular the one to the other. The molding elements are mounted on a frame in a mutual covering so as to form a succession of triangular cavities and projections.

So as to adjust the dimensions of the tread and the riser these molding elements may be displaced the ones with respect to the others.

Thus for adjusting the width of the treads, each molding element is displaced so as to cover more or less the adjacent molding element whereas for adjusting the height of the risers each molding element is spaced more or less from the adjacent molding element. Each molding element bears on the adjacent molding element, with interposition of wedges.

The principal inconvenience of this type of molding resides in the fact that this latter is largely unsealed. There then results at the time of molding losses of laitance. This laitance flows out on the adjusting mechanisms for the positioning of the molding elements. Upon drying, the laitance blocks this mechanism. Because of this inconvenience, one skilled in the art, after each molding, must proceed to the cleaning of the mold. This long and onerous operation consequently encumbers the cost of use. Moreover, the loss of laitance is manifested in the obtention of molded elements having a rough or grainy appearance.

Another inconvenience of this type of molding resides in the fact that it is impossible to mold staircases of which the treads form an acute angle with the risers, so as to form a curved interval.

SUMMARY OF THE INVENTION

The present invention has as an object to overcome these inconveniences by providing an adjustable mold particularly sealed to concrete, with which there may be realized, for example, staircases of differing dimensions of the type having a straight line extent of which the treads are perpendicular to the risers or form an acute angle with these latter. To this end, the adjustable mold, according to the invention, comprising a frame on which is mounted a base, a forward lateral wall, a rear lateral wall and two longitudinal walls, the said base being constituted by juxtaposed molding elements each arranged at a dihedral angle, which dihedral angle is constituted by a wall adapted to form the tread and a wall adapted to form the riser, is characterized essentially in that the molding elements are mounted on movable frames on longitudinal guide rails and in that a flexible strip, sealed to the concrete, is stretched on the base of the mold by stretches mounted at the extremity of the mold and is forced to cover and conform to the shape of the base of the mold, and thus the shape of the dihedral angle of each molding element, by winding on rollers mounted beneath the base of the mold between two molding elements and by gripping between the molding elements. It will immediately be understood that the base of the mold is particularly sealed.

According to another characteristic of the invention, the two walls of each molding element designed to form the tread and the riser are each constituted in two sections of wall, a containing section and a contained section slidably mounted in the preceding along the width of the wall, with each of which cooperates an actuation mechanism which forces the sliding of the contained section in one direction or the other so as to adjust the width of the wall. According to another characteristic of the invention, these two walls are articulated the one to the other along the edge of the dihedral angle and each cooperate with a telescoping arm for modifying the planar angle of the dihedron. These characteristics permit the molding of staircases of differing dimensions of which the treads are perpendicular or not perpendicular to the risers.

According to yet another characteristic of the invention the longitudinal walls of the mold are movable in vertical translation and their face turned toward the interior of the mold equipped with a flexible wall which is applied with pressure against the edge of the flexible wall covering the base. This characteristic further increases the tightness of the mold.

BRIEF DESCRIPTION OF THE DRAWINGS

Another advantages and characteristics of the invention will appear from a reading of the description of a preferred embodiment given by way of non-limiting example with reference to the accompanying drawings in which.

DETAILED DESCRIPTION OF THE INVENTION

Figure 1:
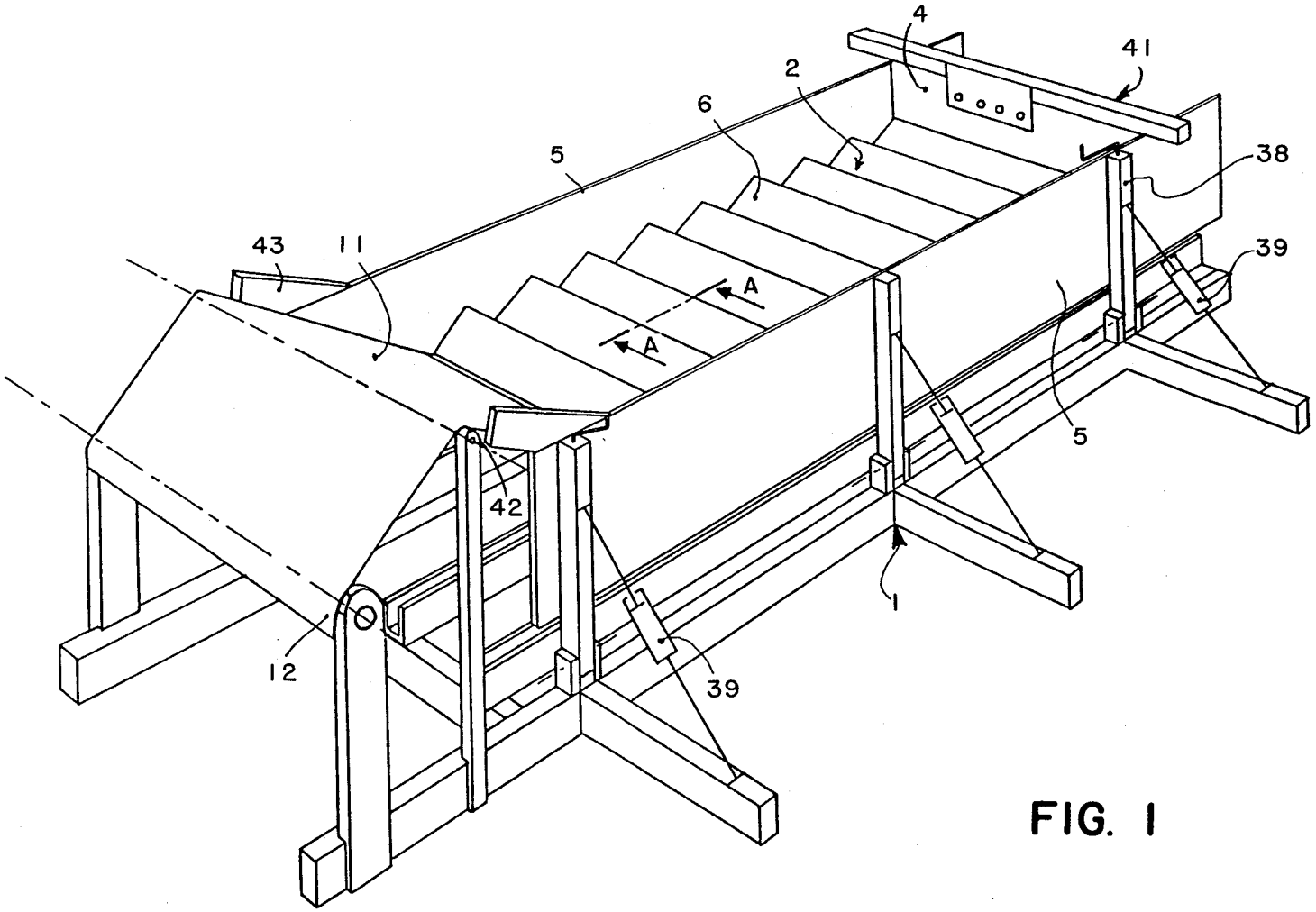
FIG. 1 is a view in perspective and revealed of a mold according to the invention.
Figure 2:
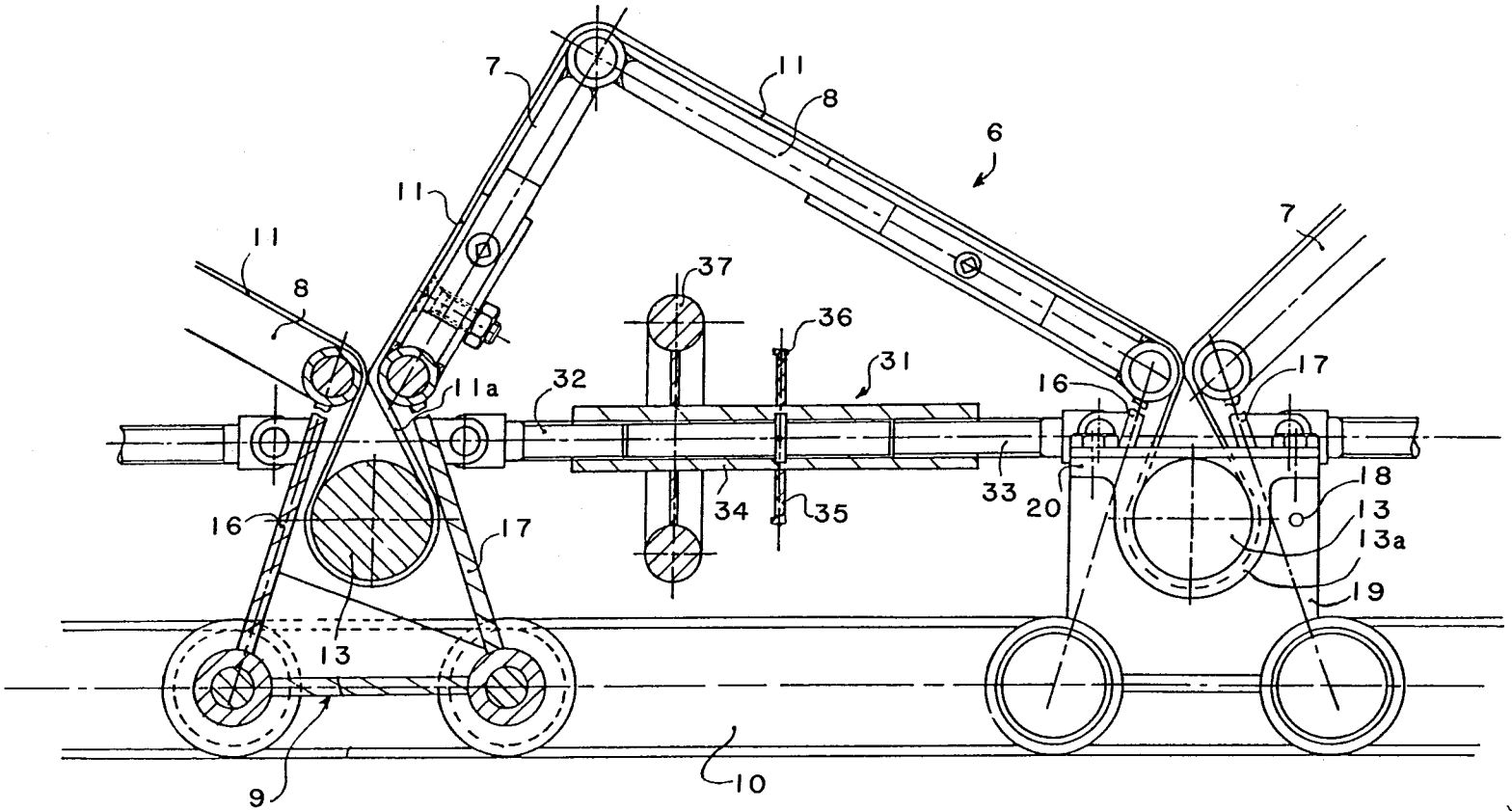
FIG. 2 is a view in partial section along the line A—A of FIG. 1.

As is shown, the adjustable mold according to the invention for the manufacture of staircases with straight line extent comprises a frame 1 on which is mounted a base 2, a forward lateral wall, a rear lateral wall 4 and two longitudinal walls 5 which define with the base a space in which the concrete is poured. The base 2 is constituted by juxtaposed molding elements 6 each arranged in a dihedral angle which dihedral angle is constituted by a wall 7 intended for the formation of the tread and a wall 8 intended for the formation of the riser. These two walls are adjustable in width so as to adjust the height of the riser and the width of the tread, and each cooperating with at least one telescoping arm so as to adjust the planar angle of the dihedron and thus the angle of the step projection.

Each molding element 6 is disposed in the mold in a transverse manner to the longitudinal axis of this latter. The length of each molding element 6 is equal to the maximum length that a step of the staircase may have. Purely by way of example, the length of each molding element is equal to 1.60 m.

The molding elements 6 are each supported along their length by carriages 9 movably mounted on horizontal rails 10, longitudinal to the mold, and fixedly mounted on the frame 1 of this latter.

These molding elements are applied with pressure the ones against the others under the action of hydraulic jacks 14, or other pressing mechanisms.

When the molding elements are pressed the ones against the others, the lower edges of the walls 7 and 8 of each of these latter are maintained by the movable carriages 9 along a same horizontal plane.

On the base 2 of the mold and thus on the molding element 6 is stretched by stretchers 12 each mounted at the extremity of the mold, a flexible strip 11, continuous, sealed to the concrete, which is forced to cover and conform to the shape of the base 2 of the mold, by winding on rollers 13 mounted beneath the base 2, each between two molding elements 6, and by gripping between the molding elements when these latter are maintained pressed the ones against the others under the action of the hydraulic jacks. The flexible strip 11 formed from a synthetic material, for example PVC urethane has a width equal to the length of each molding element 6 so as entirely to cover each of these latter.

The rollers 13 mounted beneath the base 2, each between two molding elements 6, pivot in extremity bearings 13A carried by the structure of the movable carriages 9.

These rollers 13 each force the flexible strip 11 to be applied on the walls 7 and 8 of each molding element 6. In this manner, with respect to the two adjacent molding elements, the flexible strip 11 is applied from the very first on the wall 7 of this element than on the wall 8 of this same element. Beneath the lower edge of the wall 8 of this element, the flexible strip is wound on the roller 13 before being applied on the wall 7 of the adjacent element.

Thus the strip 11 between these two elements and beneath the base 2 forms a loop **11*a* that is closed when these two elements are pressed the one against the other. This band 11*a* is closed at the level of the lower edge of the wall 8 on the one hand and at the level of the lower edge of the wall 7** on the other. These two edges are rounded.

It will be understood that the strip 11 is gripped between the edges of these two walls and that each one of the parts of the loop that form this strip, come to be pressed the one against the other.

Advantageously, between two adjacent molding elements, there is interposed a removable angled molding element 15 intended to form the connection between the riser and the tread, this connection forming the projection of the step.

This molding element comprises a tail **15*a* interposed between the two parts of the loop, at the level of the lower edges of the walls 7 and 8. This tail 15*a* is mounted beneath a facing 15*b* which is applied on the base 2 of the mold above the lower edges of the walls 7 and 8. This facing 15*b* has a complementary shape to that given to the connection between the tread and the riser. Preferably this facing is bent so as to form a rounded angle. Advantageously the tail 15*a* has a bulge which forces the facing 15*b*** to be plated on the base of the mold.

It will be understood that any type of element could be inserted into the mold. Particularly, an immersed metallic element provided with anchoring feat could be inserted into the concrete. This element is intended to form a metallic step projection. Moreover, this element is provided with anti-skid grooves.

These angle elements are each mounted between two adjacent elements 6 prior to these latter being applied with pressure the one against the other.

For interposing these angled elements, it is therefore necessary that the molding element 6 may be spread apart the ones from the others so as to open the loops **11*a* that form the surface 11** and to liberate between the parts of each loop a space, in which is disposed the tail of the corresponding angled element. It must similarly be noted that for adjusting the width of the steps of the staircase and the height of these latter, it is similarly necessary to spread the molding elements apart, the ones from the others, for reasons which will be explained further on.

For spreading apart two adjacent molding elements, the one from the other, each movable carriage, according to the preferred embodiment is provided with two jambs 16 and 17 one of which, the jamb 16, is fixedly mounted on the carriage and receives in connection, along a horizontal axis and transverse to the longitudinal axis of the mold, the lower edge of the wall 8 of one of the elements 6 and the other of which, the jamb 17 is pivotally movable and receives in connection, always along a horizontally axis and transverse to the longitudinal axis of the mold, the lower edge of the wall 7 of the other element 6.

These two jambs are mounted on a stage of the carriage equipped with rolling elements which roll in the guide rails 10.

The jamb 16 is rigidly fixed to this stage by a bracket whereas the jamb 17 is articulately mounted by its lower extremity in a clasp fixed to this stage. It will be understood that the jamb 17 is connected to the clasp along a horizontal axis, transverse to the longitudinal direction of the mold.

So as to limit the pivotal movement of this jamb 17 in the direction of the separation of the molding elements 6, an abutment 18 fixedly mounted on a vertical side-piece 19 fixed on the stage of the carriage, is provided. This carriage is moreover equipped with an upper horizontal stage 20 fixed to the side piece 19. This stage fixedly receives the bearing 13*a* of the roller 13 which is disposed between the two jambs 16 and 17. So as to support the walls 7 and 8 along all their length, the jambs 16 and 17 have the form of a rectangular wall which extends beneath the base 2 transversely to the longitudinal axis of the mold.

Moreover, each jamb is mounted on two movable carriages 9.

Accordingly to this embodiment, the walls constituting the jambs, are connected either to the wall 7, or to the wall 8 by a hinge system.

Thus the walls constituting the jambs and the walls 7 and 8 are equipped with regularly spaced hinges.

Between the hinges of the jambs, are engaged the corresponding hinges of the walls 7 or 8 and these various hinges receive a pin assembly.

It will be understood that each molding element 6 is supported by a jamb 17 mounted on several carriages 9 which receive the jamb 16 for support of the rear element 6, and is supported by a jamb 16 mounted on several carriages 9 which receive the jamb 17 for supporting the forward element 6.

This apparatus offers the advantage of constituting a chain of carriages and elements 6.

Also for separating the various elements 6 the ones from the other it suffices to exert a traction on the first and/or on the last element of the chain. This traction force is transmitted for example from the very first to the jamb 17 of the last element of the chain and after which this element has pivoted and has come into support on the abutment 18, is transmitted to the front rear element of the chain. Thus, the elements 6 spread apart the ones from the others in a successive manner.

The length of the strip in the mold, increases or diminishes according to whether the molding elements 6 are spread apart or on the contrary are drawn nearer the ones to the others. So as to permit this length variation, the stretchers 12 for the strip are constituted by stretching rollers on each of which the said strip is wound several revolutions. The stretching rollers are actuated in rotation by motor mechanisms of any known type.

These stretching rollers are actuated in rotation in the direction of the winding of the strip when the elements 6 are drawn nearer the ones of the others.

The rotation of these rollers is interrupted when these elements 6 are pressed the ones against the others. At this time, these rollers are blocked in rotation in the direction of unrolling of the band by any known means, for example, by a wheel with detents.

It will be understood that the rotation of the rollers is freed in the direction of unrolling of the strip when the molding elements 6 are spread apart the ones from the others.

As previously stated, each molding element 6 is arranged in a diherdral angle, the said dihedral angle is constituted by a wall 7 designed to form the tread and by a wall 8 designed to form the riser, the wall 7 being connected with a jamb 17 and the wall 8 with a jamb 16.

So as to adjust the step width and to adjust the step height, the walls 7 and 8 are each constituted in two wall sections, one containing section 21 and one contained section 22 slidably mounted in the preceding along the width of the wall, with each of which cooperates an actuation mechanism which forces the sliding of the contained section in one direction or in the other so as to adjust the width of the wall.

According to a preferred embodiment, the containing section 21 is connected to the corresponding jamb.

This containing section is constituted by two walls 24, constituting a covering.

In this covering, is fixedly mounted at least one metallic element 25 which extends along the length of the wall.

This metallic element comprises at least two ramps 26 provided in opposition the one to the other.

The wall section 22 similarly has at least two ramps 27 provided in opposition the one to the other which each come to cooperate with a ramp 26 of the element 25 so as to form a triangular space.

In these two triangular spaces thus formed, are mounted two essentially triangular variators 28 actuated in translation in opposite directions the one to the other by a screw that is maneuverable in rotation and blocked in translation. The triangular variators 28 and the screw 29 constitute the actuation mechanism recited above.

The screw 29 extends into the wall 7 or 8 along a longitudinal direction. This screw, on a portion of its length, comprises a right-handed screw interval whereas the other portion of its length is threaded according to a lefthanded interval. A threaded portion of this screw is engaged in a cut opening provided in one of the variators 28 whereas the other threaded portion of the screw is engaged in a cut opening effected in the other variator. These variators are traversed from one side to the other, by this screw along their longitudinal axis.

The screw is similarly engaged in the transverse opening of a slide 30, slidably guided in the direction of the width of the wall 7 or 8 in two transverse housings one of which is affected in the contained section 21 and the other of which is effected in the element 25.

Thus, when the screw is actuated in rotation in one direction, the variators 28 are drawn closer the one to the other or on the contrary, are withdrawn.

Figure 3:
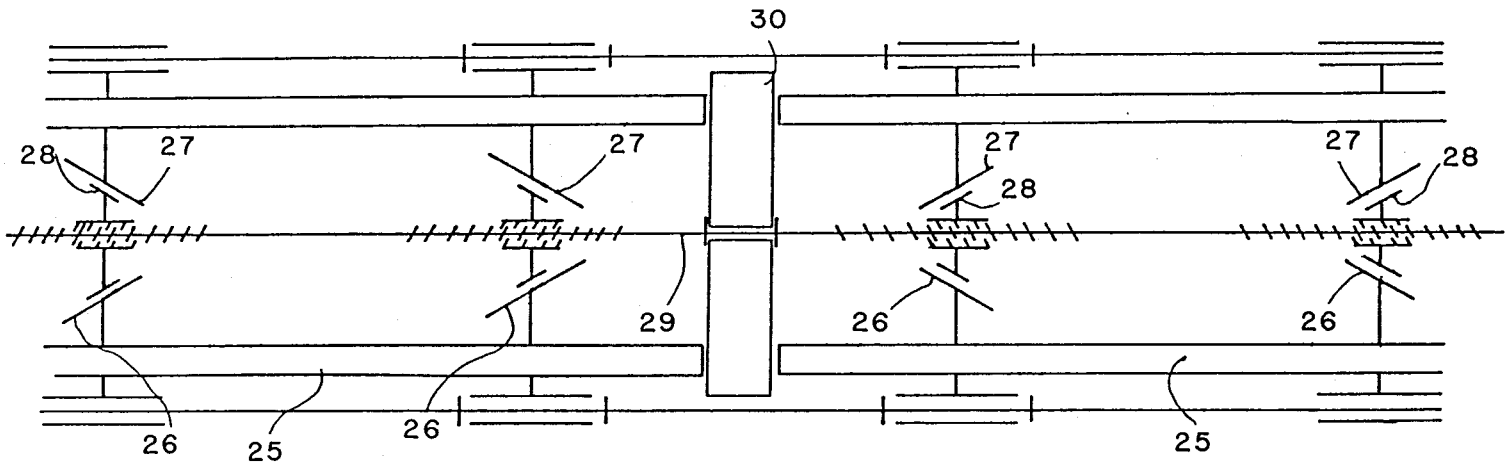
FIG. 3 is an operational scheme of the mechanism for adjusting the width of the walls of each molding element.
Figure 4:
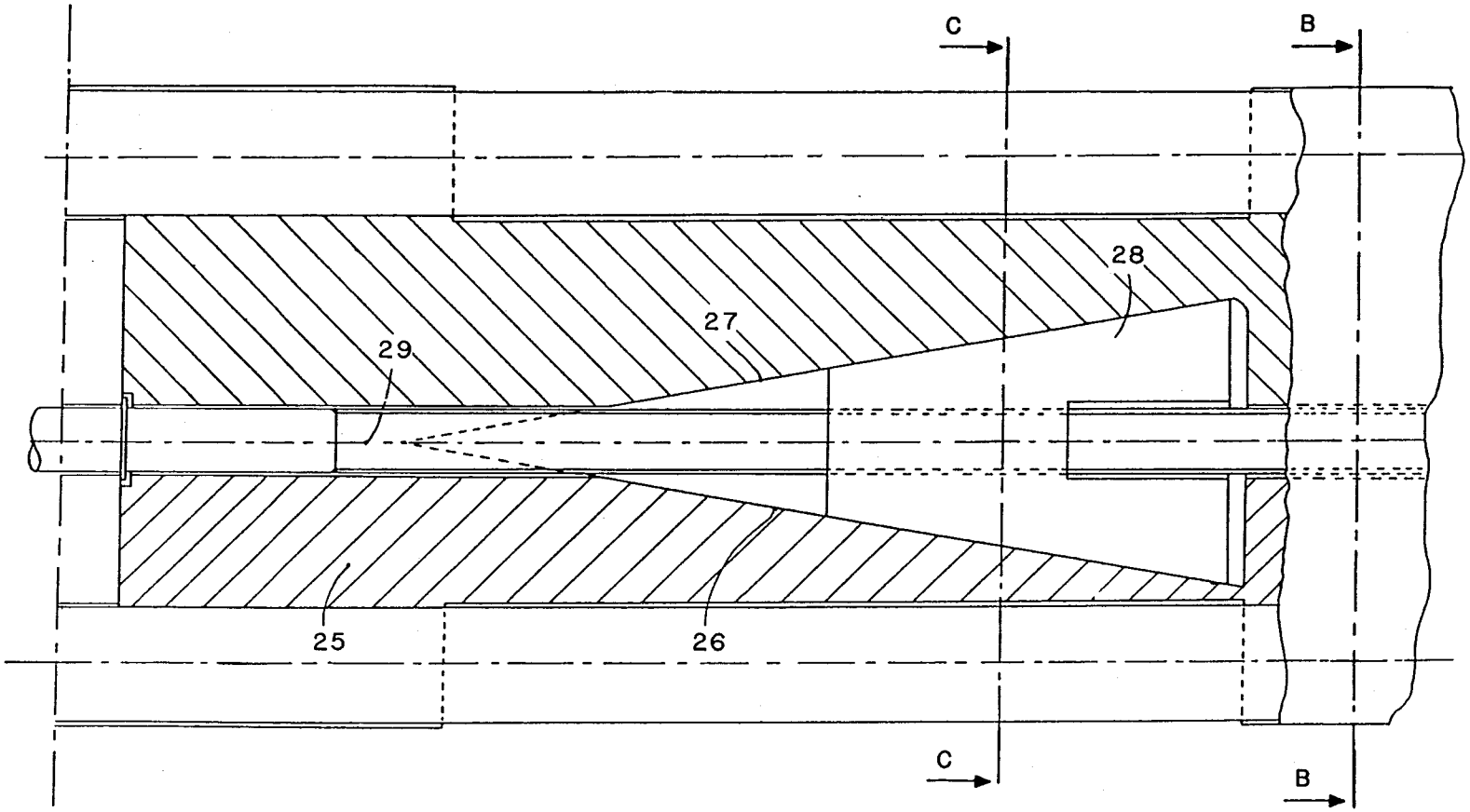
FIG. 4 shows the detail of such a mechanism.
Figure 5:
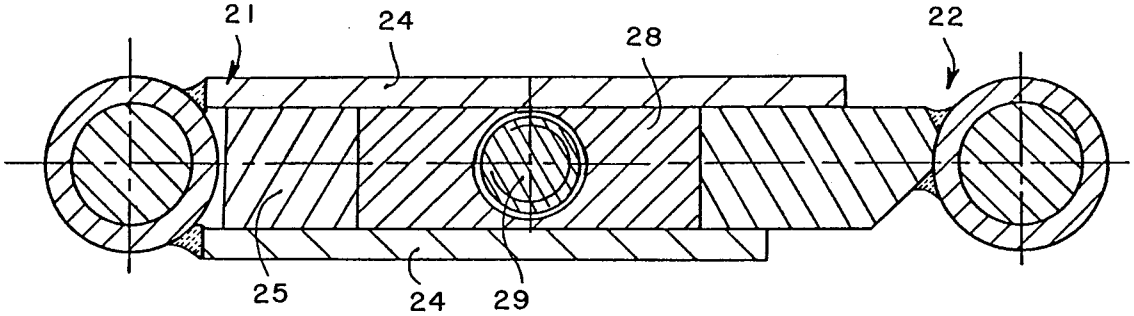
FIGS. 5 and 6 are sectional views along the lines B—B and C—C of FIG. 4.
Figure 6:
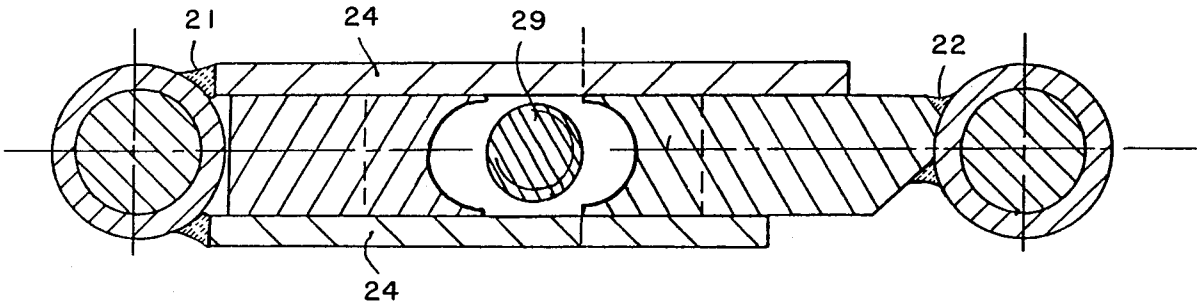
Figure 8:
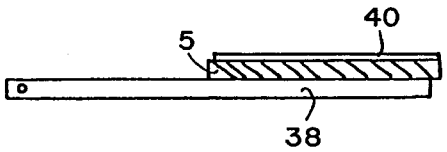
FIG. 8 is a transverse sectional view of an angled molding element.
Figure 7:
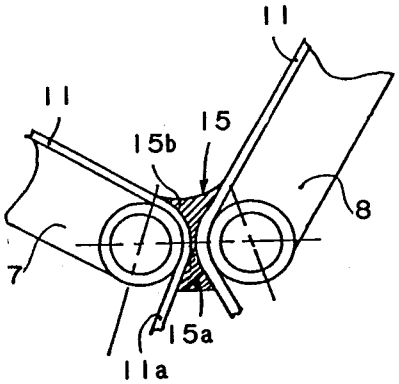
FIG. 7 is a sectional view of a longitudinal wall.
Figure 9:
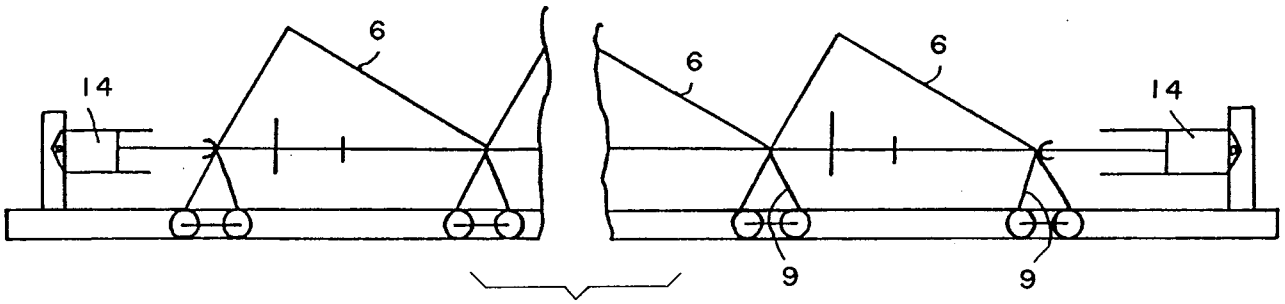
FIG. 9 is a schematic view of molding elements pressed the ones against the others.

When the variators are drawn the one towards the other (FIG. 3), these latter repel the contained wall section in the direction of an increase of width. Moreover, as these variators are engaged on the ramps 26, the screw 29 undergoes a translatory movement directed in the direction of an increase of width. The purpose of the slide is to guide the screw in the course of this movement.

Preferably, the element 25 and the contained wall section each comprise four regularly spaced ramps and the actuation mechanism comprises four variators 28.

It will be understood that for adjusting the width of the walls 7 or 8 there may be employed any other actuation mechanism. According to a variation, this actuation mechanism is constituted by a plurality of hydraulic or electric jacks, which are each connected, by any known means, to the containing wall section and to the contained wall section. So as to adjust the angle of the step projections such that this angle is right or acute, the walls 7 and 8 of each molding element are articulated the one to the other along the edge of the dihedral angle that it forms and this spacing between the articulation axes of these walls to the jambs 16 and 17 is adjustable.

By adjusting this spacing, the planar angle of the dihedron is modified. The modification of the value of this planar angle leads to modifying the angle of the step projection, this angle being formed by a wall 7 of an element and by the wall 8 of the adjacent element. As the planar angle of the dihedron is equal to the angle of the step projection, it suffices only to give to the planar angle of the dihedron the desired angle for the angle of the step projection. Preferably, the walls 7 and 8 are articulated the one to the other by a hinge-type system as previously described. For adjusting the spacing of the articulation of the walls 7 and 8 to the jambs 16 and 17, there is provided at least one telescoping arm 31 articulated through one of its extremities to the jamb 17 and through its other extremity to the jamb 16.

This telescoping arm is constituted by two threaded rods 32 and 33 one of which is connected to the jamb 17 and the other of which is connected to the jamb 16. Each threaded rod has a screw interval opposite to that of the other rod. The threaded rods cooperate with a sleeve 34 comprising two internal threadings which each cooperate with the screw interval of a threaded rod. This sleee is provided with a means for driving in rotation. The rotation of the sleeve according to one direction of rotation provokes, either an increase of the length of the arm 31, or a decrease.

Advantageously, with each molding element 6 are associated several telescoping arms 31 simultaneously maneuverable by a same transmission.

By way of example, this transmission is constituted by a plurality of toothed gears 35 each supported on a sleeve 34 and by a chain 36 which engages on each toothed gear. Moreover, the sleeve 34 of the first telescoping arm 31 comprises an operation handwheel 37. According to a variation, each arm 31 is connected to the lower edge of the walls 7 and 8. It will be understood that after adjustment of the molding element 6, the length of the base of the mold is capable of varying in the direction of increase or decrease. At the time of this variation it is necessary that the carriages 9 always remain on the guide rails. To this end, the length of the guide rails corresponds to the maximum length of the staircase which may be fabricated with this mold.

Moreover, at the time of this variation of length it is necessary that the rear stretcher roller 12 of the strip may be displaced with respect to the frame 1 of the mold.

To this end, this stretcher roller is mounted on a support, not shown, capable of sliding on the frame 1 and of being locked at the desired position. The length of the longitudinal walls 5 corresponds to the maximum length of the staircase which may be fabricated with the mold. Advantageously the longitudinal walls may be adjusted in height such that the distance between the upper edge of these walls 5 and the base 2 of the mold corresponds essentially to the thickness that the staircase must possess.

To this end, each wall 5 is slidably mounted on jambs 38 connected to the frame 1 and cooperating with several translatory drive system, of the screw and screw nut type, each manually operable by a crank or automatically by a motor mechanism.

By way of example, the screw nut of each system cooperates in fixation with the longitudinal wall whereas the screw cooperates in guiding in rotation with the corresponding jamb. With each of these walls are associated several jacks 39. These jacks have as an object, either to apply the longitudinal walls against the edge of the molding elements and thus to close the mold, or to separate them angularly from the base 2 of the mold so as to open these latter. Each jack is articulately mounted on one of the jambs of the wall and on the frame 1.

So as to reinforce the tightness of the mold, the face of the longitudinal walls 5 turned toward the interior of the mold, is covered with a sheet 40 of a deformable elastic flexible material, which comes to be layered against the edge of the strip 11. The lateral walls recited above are of a complementary shape to that of the extremity of the staircase.

Preferably, these lateral walls are removable for their replacement and are each carried by a support 41. This support is constituted by a cross member fixedly mounted on the upper edge of the longitudinal walls and by a vertical stage fixed to the said cross member. This stage extends downward, above the mold and fixedly receives the lateral wall. This lateral wall constitutes in fact a shield which is transversely disposed between the longitudinal walls.

The support 41 for one of the lateral walls, preferably the back wall 4, may be displaced the length of the longitudinal walls 5 so as to be able to realize a staircase with the desired number of steps. With this type of staircase, it is possible to realize a staircase equipped with a landing. To this end, the strip 11 in the forward portion of the mold is supported by an inclined plane 42 of adjustable inclination, fixedly mounted on uprights fixed to the support. Moreover, the longitudinal walls 5 each fixedly receive, a removable side piece 43 which is disposed laterally to the inclined plane 41. It will be understood that for molding the landing, the forward lateral wall and its support are withdrawn from the mold.

The strip 11 beyond the landing is wound on the forward stretcher roller 12. This stretcher roller is supported by a support fixedly mounted on the frame 1.

As previously stated, there are provided jacks 14 for forcing the molding elements to come into pressure the ones against the others. These jacks 14 act on the extreme molding elements through the intermediary of a compensator. The mold according to the invention permits the manufacture of staircases of various dimensions and is particularly sealed. Moreover, this mold may be used for the manufacture of shafts. To this end, the mold receives vertical, longitudinal shields of which the lower edge conforms to the profile of the base 2 of the mold.

The preceding has described a mold intended for flat molding, but it is obvious that the arrangements previously described could be used on a mold for vertical molding.

It goes without saying that the present invention may receive any arrangements and variations without departing whatsoever from the scope of the present patent.

I claim:

1. Adjustable mold for the manufacture of concrete staircase elements, said mold comprising a frame (1) on which is mounted a base (2), a forward lateral wall, a rear lateral wall (4) and two longitudinal walls (5), the said base being constituted by juxtaposed molding elements (6) each arranged in a dihedral angle which dihedral angle is constituted by a wall (7) intended to form the tread and by a wall (8) intended to form the riser characterized in that each molding element (6) is supported by carriages (9) movably mounted on horizontal guide rails (10), longitudinal to the mold, mounted on the frame (1) and in that a flexible strip (11) sealed to the concrete is stretched by stretchers (12) mounted at each extremity of the mold and is forced to cover and to conform to the shape of the base (2) of the mold by winding on rollers (13), each roller being mounted beneath the base (2) between two molding elements (6), and by gripping between the molding elements when these latter are maintained pressed the ones against the others by jacks (14).

2. Adjustable mold according to claim 1 characterized in that the lower edges of the tread and riser walls of each molding element are disposed along a same horizontal plane.

3. Adjustable mold according to claim 1 characterized in that each movable carriage (9) is provided with two jambs (16) and (17) one of which, the jamb (16), is fixedly mounted on the carriage and articulately receives the lower edge of the riser wall (8) of one of the molding elements, and the other of which, the jamb (17), is pivotally movable on the carriage and articulately receives the lower edge of the tread wall (7) of the adjacent molding element, these said molding elements being pressed the one against the other by the lower edges of the tread and riser walls.

4. Adjustable mold according to claim 3 characterized in that the jambs (16) and (17) are present in the form of a rectangular wall which is extended beneath the base (2) transversely to the longitudinal axis of the mold and that each jamb is mounted on several carriages.

5. Adjustable mold according to claim 1 characterized in that each molding element (6) is supported by a pivotable jamb (17) mounted on several carriages (9) which receive a fixed jamb (16) for supporting the molding element (6) from behind and is supported by a fixed jamb (16) mounted on several carriages (19) which receive the pivotable jamb (17) for supporting the forward molding element (6) so as to constitute a chain of carriages (9) and molding elements (6).

6. Adjustable mold according to claim 1 comprising a flexible strip (11), stretched by stretchers (12) characterized in that the stretchers are constituted by stretcher rollers and that the strip is wound several revolutions on each of these rollers.

7. Adjustable mold according to claim 1 characterized in that the flexible strip (11) is applied first on the tread wall (7) of an element, then on the riser wall (8) of this element, then is wound beneath the edge of this riser wall (8), around a roller beneath the base (13) and then is applied on the tread wall (7) of the contiguous element.

8. Adjustable mold according to claim 7 characterized in that the flexible strip (11) between two contiguous elements forms a closed loop (11*a*) around the roller beneath the base at the level of the lower edge of the riser wall (8) and the lower edge of the tread wall (7), when these molding elements are pressed the one against the other.

9. Adjustable mold according to claim 1 characterized in that each tread and riser wall of a molding element (6) is constituted by two wall sections, a containing section (21) and a contained section (22) slidably mounted in the preceding along the width of the tread and riser walls with each of which cooperates an actuation mechanism which forces the sliding of the contained section in one direction or the other so as to adjust the width of the tread and riser walls.

10. Adjustable mold according to claim 1 characterized in that the tread and riser walls of each molding element are connected the one to the other, along the edge of the dihedral angle which they form and that the spacing between the articulation axes of these walls to the jambs (16) and (17) is adjustable.

11. Adjustable mold according to claim 10 characterized in that the spacing between the articulation axes of the tread and riser walls to the fixed and pivotable jambs respectively is adjusted by at least one telescoping arm (31).

12. Adjustable mold according to claim 11 characterized in that the tread and riser walls are associated with several telescoping arms (31) simultaneously operated by a same transmission.

13. Adjustable mold according to claim 1 characterized in that the face of each longitudinal wall, turned toward the interior of the mold is covered with a sheet (40) of a deformable, elastic, flexible material, which comes to be layered against the edge of the molding elements (6) and against the edge of the flexible strip (11).

14. Adjustable mold according to claim 1 for the manufacture of a staircase provided with a landing characterized in that the flexible strip (11) in the forward portion of the mold is mounted on an inclined plane with adjustable inclination fixedly mounted on uprights fixed to the support and that the longitudinal walls (5) each receive a removable side piece which is disposed laterally to the inclined plane.

15. Adjustable mold according to claim 1 characterized in that at least one of the lateral walls is carried by a support constituted by a crosspiece fixedly mounted on the upper edge of the longitudinal walls (5) and by a vertical stage fixed to the said cross piece, the said stage fixedly receiving in a removable manner the lateral wall, and the said support being capable of being displaced the length of the longitudinal walls (5).

16. Adjustable mold according to claim 1 characterized in that between each molding element (6) is interposed an angled molding element (15).

17. Adjustable mold according to claim 1 characterized in that between each molding element (6) is interposed an immersed element.

* * * * *